United States Patent [19]

Adrian et al.

[11] Patent Number: 4,976,345

[45] **Date of Patent: * Dec. 11, 1990**

[54] ESCALATOR HANDRAIL OBSTRUCTION DEVICE WITH SENSORS

[75] Inventors: Willy Adrian, Obernkirchen; Detlev B. Moldenhaur, Stadthagen, both of Fed. Rep. of Germany

[73] Assignee: Otis Elevator Company, Farmington, Conn.

[ * ] Notice: The portion of the term of this patent subsequent to May 15, 2007 has been disclaimed.

[21] Appl. No.: 414,865

[22] Filed: Sep. 29, 1989

[51] Int. Cl.[5] ..... B66B 29/04

[52] U.S. Cl. ..... 198/323; 198/338

[58] Field of Search ..... 198/323, 338

[56] References Cited

U.S. PATENT DOCUMENTS

| | | | |
|---|---|---|---|
| 2,846,045 | 8/1958 | Fowler | 198/323 |
| 3,809,206 | 5/1974 | Bredehorn et al. | 198/323 |
| 3,835,977 | 9/1974 | Hewitt et al. | 198/323 |
| 3,934,699 | 1/1976 | Saito et al. | 198/323 |
| 4,619,355 | 10/1986 | Adrian et al. | 198/323 |

FOREIGN PATENT DOCUMENTS

| | | | |
|---|---|---|---|
| 0061088 | 5/1977 | Japan | 198/323 |
| 0034288 | 3/1978 | Japan | 198/323 |
| 0604787 | 4/1978 | U.S.S.R. | 198/323 |

*Primary Examiner*—D. Glenn Dayoan

*Attorney, Agent, or Firm*—William W. Jones

[57] ABSTRACT

An elastomeric collar is positioned at the mouth of the escalator handrail reentry housing. The collar will deform when subjected to forces running parallel to the direction of travel of the handrail. Sufficient deformation of the collar will activate a switch which turns the escalator off. if an object enters the reentry housing and becomes lodged therein against the handrail, the forces generated thereby normal to the direction of travel of the handrail will activate a pressure sensor which in turn will turn the escalator off.

4 Claims, 4 Drawing Sheets

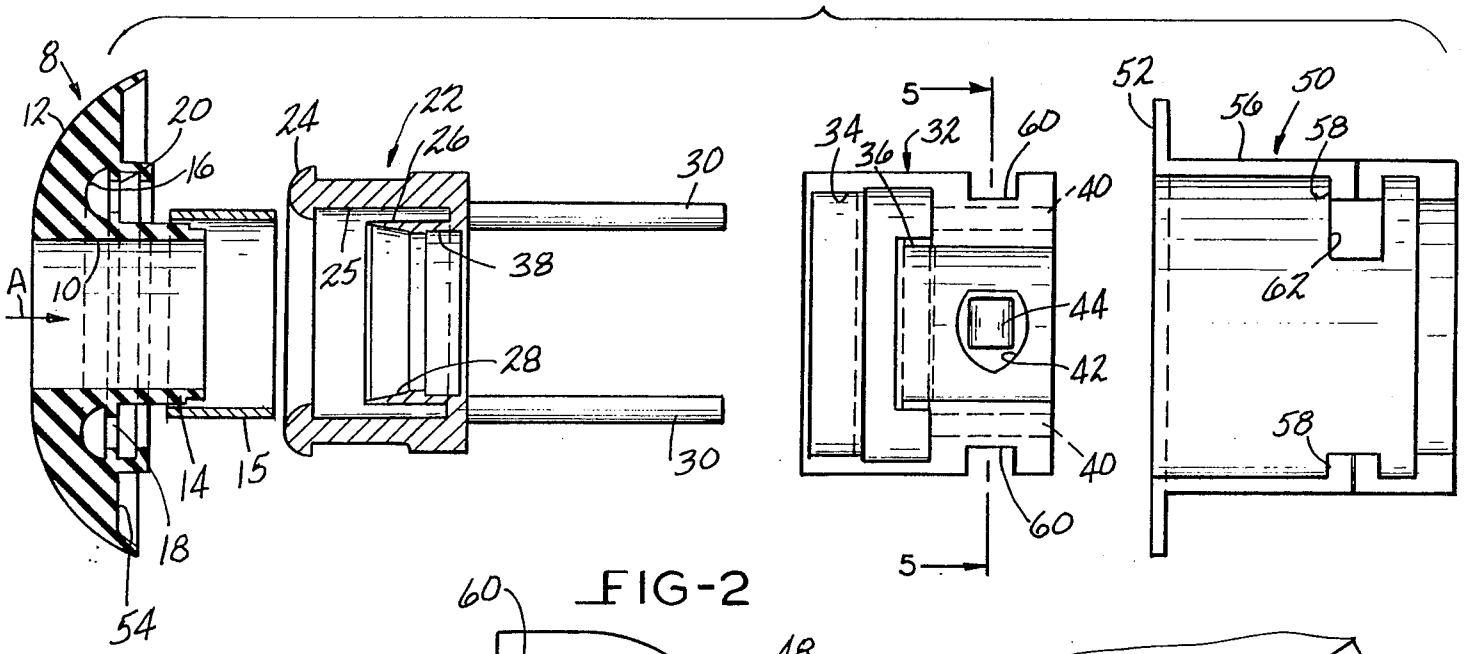
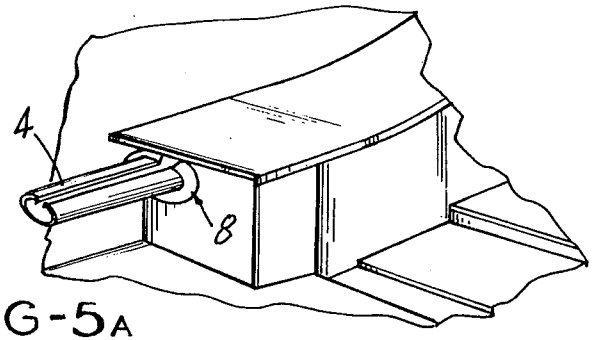
FIG-5A
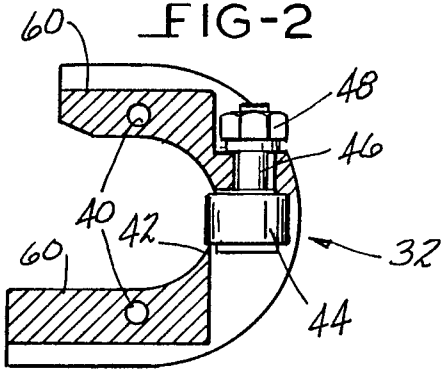
FIG-2
FIG-5

ESCALATOR HANDRAIL OBSTRUCTION DEVICE WITH SENSORS

TECHNICAL FIELD

This invention relates to a safety device for use on the reentry housing of an escalator handrail. More particularly, the device of this invention is operable to sense longitudinal and radial forces occurring in the area of the reentry housing, and is further operable to turn the escalator off in appropriate cases.

BACKGROUND ART

The handrail on an escalator is driven over a handrail guide in synchronism with the moving steps of the escalator, or other moving walkway. At the exit landing of the escalator, the handrail reverses its direction of travel, over a curved newel in the more modern escalators, and moves along a hidden return path of travel. The escalator handrail passes through a reentry housing as it begins its return travel. Care must be taken that objects or materials are not pulled into the reentry housing by the moving handrail lest damage to the mechanism or injury to a passenger may occur.

DISCLOSURE OF THE INVENTION

This invention relates to a device which senses abnormal forces exerted in the area of the reentry housing, which forces are the result of an object being pulled into the reentry housing by the handrail, or which forces are the result of an object or the like being jammed into the reentry housing. When such abnormal forces are detected, the escalator is turned off and a warning alarm is sounded.

The device includes a collar that is mounted in the mouth of the reentry housing and through which the handrail moves. An elastomeric bumper is fitted into the collar and forms the outermost element of the device. The bumper is the element of the device which will be directly contacted by anything which is on the handrail as the latter enters the reentry housing. A plurality of pins are mounted on the bumper and extend through and past the collar in the direction of travel of the handrail. The pins are operable to contact a switch mounted in the reentry housing adjacent to the handrail when the bumper is sufficiently deformed by contact with something on the handrail which is being pushed by the handrail into the reentry housing. When the pins contact the switch, the escalator is shut off and an alarm is sounded. When the cause of the shutdown is removed from contact with the bumper, the latter's inherent resiliency will move the pins away from the switch and the escalator will restart. There is also a radial pressure sensor disposed between the bumper and the collar for detecting material which is carried past the bumper by the handrail. Such material will encounter the collar and will jam against the collar. This will cause a radially outwardly directed force against a portion of the bumper disposed adjacent to the handrail, which radial force will be detected by the radial pressure sensor. When this occurs, the pressure sensor will shut the escalator off and sound an alarm. After the jam is cleared, the escalator must be manually restarted.

It is therefore an object of this invention to provide a safety device for use at an escalator handrail reentry housing.

It is a further object of this invention to provide a device of the character described which can shut the escalator off upon the detection of foreign material at the handrail reentry housing.

It is an additional object of this invention to provide a device of the character described wherein linear and radial forces imposed on the device are detected and may serve to shut off the escalator.

These and other objects and advantages of the invention will become more readily apparent from the following detailed description of a preferred embodiment thereof when taken in conjunction with the accompanying drawings, in which:

BRIEF DESCRIPTION OF THE DRAWINGS

FIG. 2 is an exploded sectional view of the device of FIG. 1;

FIG. 5 is a sectional view taken along line 5—5 of FIG. 2; and

BEST MODE FOR CARRYING OUT THE INVENTION

Figure 1:
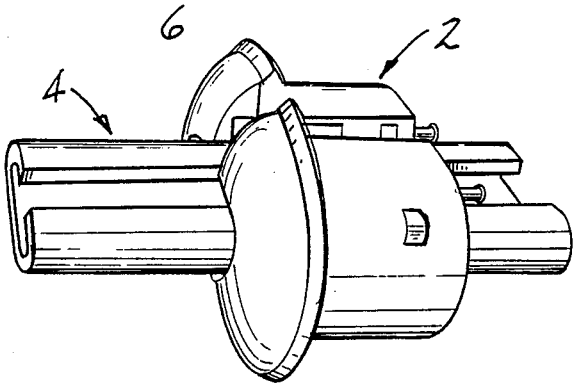
FIG. 1 is a fragmented view of a preferred embodiment of an escalator handrail safety device formed in accordance with this invention.

Referring now to the drawings, it will be noted that the device which is denoted generally by the numeral 2 surrounds the handrail 4 as the latter enters the reentry housing 6 (fragmentally shown in phantom lines). The various components of the device 2 are shown in FIG. 2. At the handrail entry end of the device 2 is a rubber bumper component 8. The bumper 8 is elastomeric, and can be formed from a material such as neoprene rubber, or the like. The bumper 8 has a through passage 10 through which the handrail 4 moves in the direction of the arrow A, and a rounded exposed surface 12 facing the direction from which the handrail advances The downstream end of the bumper 8 is formed with an annular boss 14. An annular recess 16 is formed in the downstream side of the bumper 8 about the boss 14. The recess 16 includes inner and outer lands 18 and 20, respectively. An annular base member 22 is disposed downstream of the bumper 8. The base 22 has a profiled looking boss 24 of annular configuration which is snap fitted into the bumper recess 16 and releasably held in place by the lands 18 and 20. The base 22 is also formed with an internal throat 26 which telescopes into the passage 10 of the bumper 8. The throat 26 has an axial bore 28 through which the handrail moves. A plurality of pins 30 are mounted in the base 22 and extend downstream therefrom. A guide member 32 is disposed downstream of the base 22 and is formed with a counterbore 34 which telescopes over the outside of the base 22. A boss 36 formed in the counterbore 34 telescopes into a mating portion 38 in the base 22. The pins 30 extend through passages 40 in the guide 32. The guide members 32 are preferably formed as halves of mating pairs as shown in FIG. 5 which are held together by the pins 30 when the latter are telescoped into the passages 40. Each guide member 32 has a lateral opening 42 through which a roller 44 can contact the moving handrail to guide the latter. The rollers 44 are mounted on shafts 46 secured in place by nuts 48. An outer housing or case 50, formed in mating halves overlies the assembly. The housing part 50 has an upstream flange 52 that nests into an annular marginal recess 54 in the bumper 8, and a side wall 56 that surrounds the guide 32. Inside of the housing part 50 are lugs 58 that fit into external slots 60 in the guides 32 to secure the two parts together. The nuts 48 are accessible through openings 62 in the housing 50.

Figure 3:
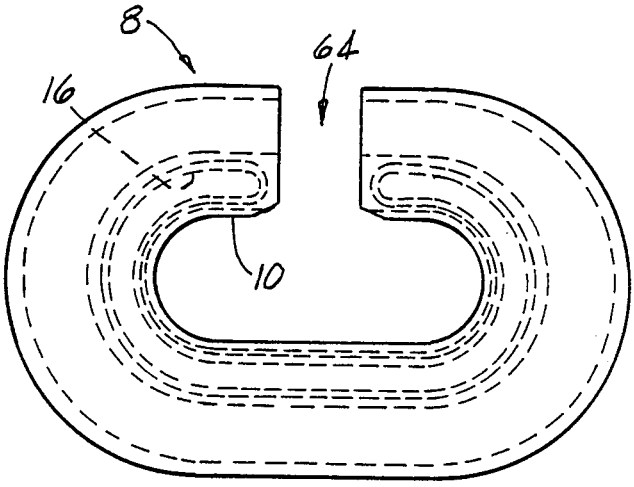
FIG. 3 is a front elevational view of the bumper component of the device of FIG. 1.
Figure 4:
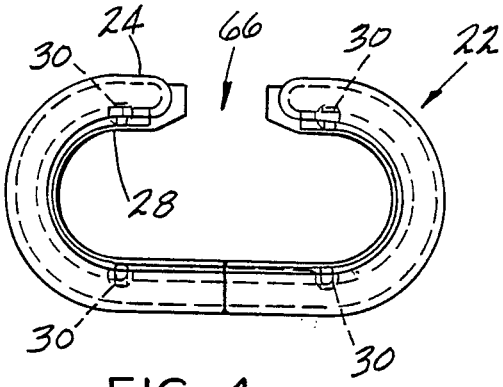
FIG. 4 is a front elevational view of the pin mounting component of the device.

FIGS. 3 and 4 are front elevational views of the bumper 8 and base 22, that show clearly the shapes of these parts. The bumper 8 and base 22 have peripheral gaps 64 and 66, respectively, which allow the handrail to be positioned in the passages 10 and 28, respectively. The shape of the bumper recess 16 and the base locking boss 24 is also clearly shown. The location of the pins 30 in the base 22 is also shown clearly in FIG. 4.

Figure 6:
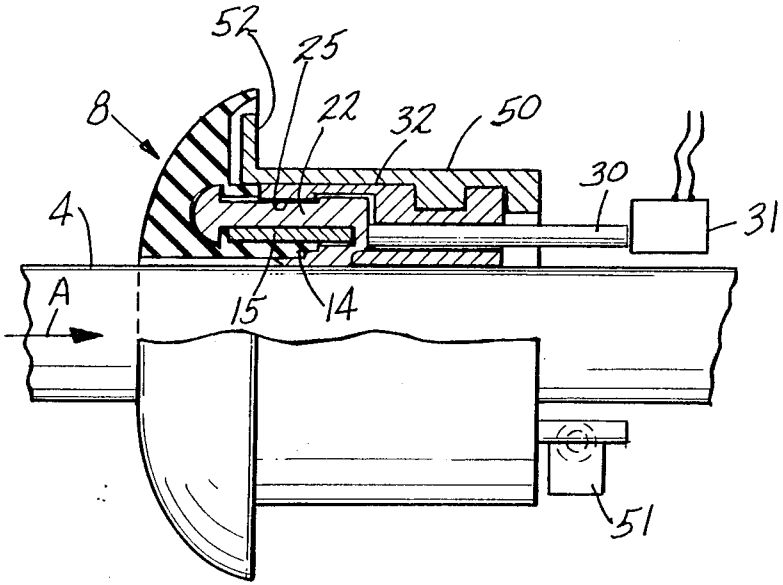

Referring now to FIGS. 6–11, there is shown a sequence of conditions which may occur at the handrail reentry, and the manner in which these conditions will be dealt with by the device of this invention. FIG. 6 shows the handrail 4 moving through the device in the direction of the arrow A. The housing part 50 engages a stop 51 fixed to the escalator truss which holds the housing 50 and guide 32 against movement in the direction of the arrow A. Thus the housing 50 and guide 32 are fixed relative to the moving handrail. The bumper 8 and base 22 can slide relative to the housing 50 and guide 32, however the natural resiliency of the bumper 8 and the fact that it engages the flange 52 on the fixed housing 50, will serve to hold the bumper 8 and base 22 in a neutral position shown in FIG. 6 wherein the pins 30 are spaced apart from a switch 31 which controls operation of the escalator power source. If the pins 30 actuate the switch 31, then the escalator will shut down. Additionally, there is a radial pressure sensor 15 interposed between the outer surface of the bumper boss 14 and the inner surface 25 of the base 22. The pressure sensor 15 is a tape consisting inside of material which is electrically conductive. The conductivity changes with pressure applied on the surface of the tape. As previously noted, as shown in FIG. 6 there are no abnormal forces acting upon the reentry assembly, and the handrail 4 is moving in a normal fashion therethrough.

Figure 7:
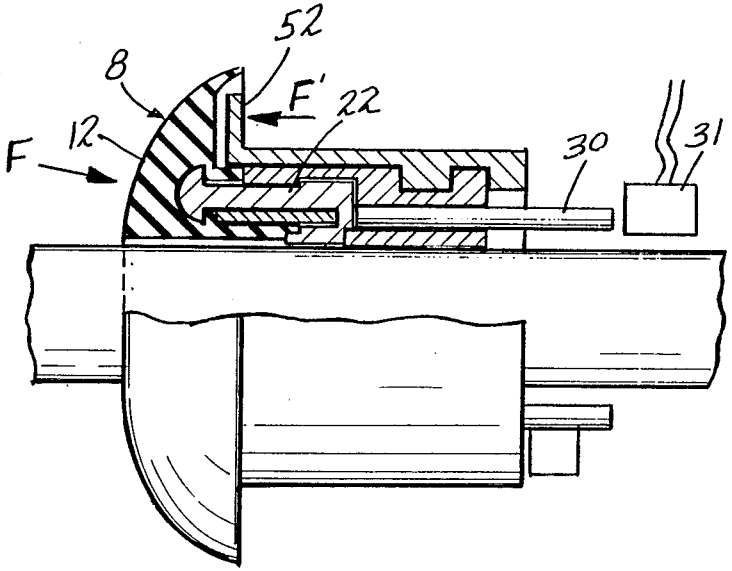
FIGS. 6–11 are sectional views of the device and the associated handrail showing various stages of the device's operation.
Figure 9:
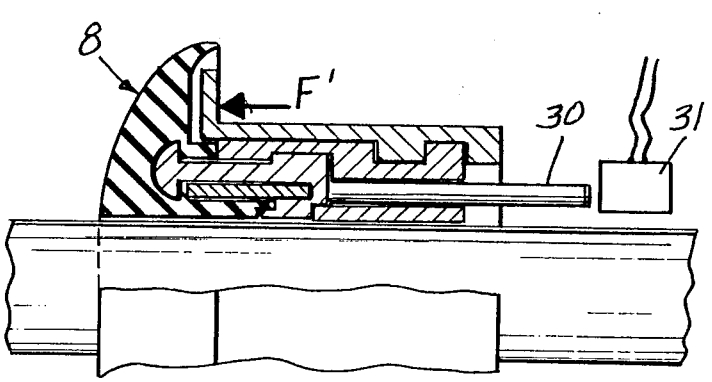
Figure 8:
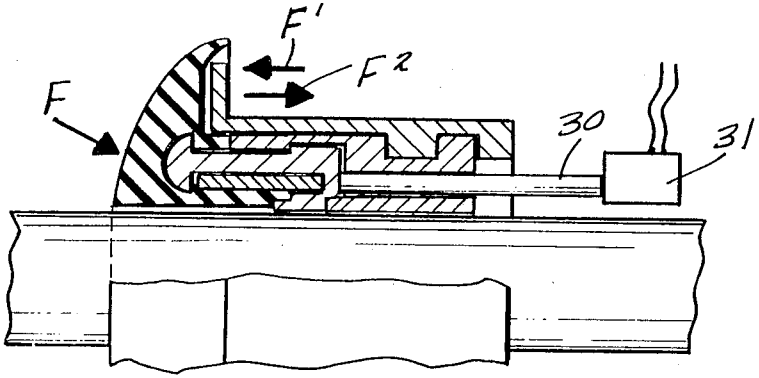

In FIG. 7, the device is viewed with a force F acting upon the surface 12 of the bumper 8, which force F is generated by a foreign object being pulled against the bumper 8 by the moving handrail 4. The natural resiliency of the bumper 8 will create a counter force $F^1$ between the bumper 8 and the fixed housing flange 52 which biases the pins 30 away from the switch 31. So long as the force F is less than the biasing force $F^1$, the pins 30 will be held away from the switch 31. Once the force F exceeds the force $F^1$, the pins 30 will be moved against the switch 31 to actuate the latter, causing the escalator to stop and causing an alarm to sound. This condition is illustrated in FIG. 8 wherein the net force acting upon the pins 30 is $F^2$, whereby the pins 30 are moved against the switch 31. At this point the source of the pressure on the bumper 8 can be investigated and removed, whereby F becomes zero, and the biasing force $F^1$ becomes the only force acting upon the pins 30, as shown in FIG. 9. The elasticity of the bumper 8 thus moves the pins 30 away from the switch 31 and the escalator is restarted, and the alarm turned off.

Figure 11:
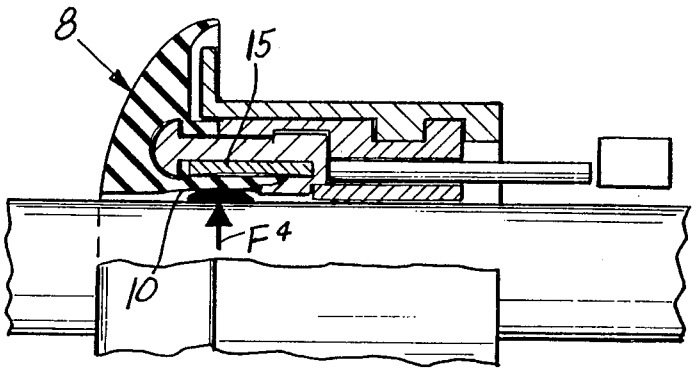
Figure 10:
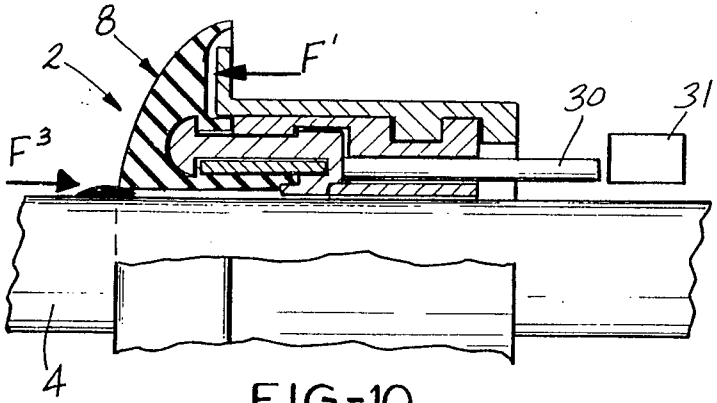

FIGS. 10 and 11 illustrate operation of the device when a foreign object or material is pulled into the device 2 by the handrail 4. The force exerted on the bumper 8 by an object at the interface between the handrail 4 and the bumper 8 is designated by $F^3$, and will have an axial component and a radial component due to its proximity to the handrail 4. When the axial component of the force $F^3$ overcomes the biasing force $F^1$ of the bumper 8, the pins 30 will be moved against the switch 31 and the alarm will sound, and the handrail 4 will stop. If the object is in the bore 10, the radial component $F^4$ of the force $F^3$ will activate the radial pressure sensor 15 by deforming the bumper boss 14 whereupon, when the force $F^4$ is applied on the sensor 15, the current i will change due to the change of conductivity. This is detected by an electronic device which in turn gives a signal that turns off the escalator.

Once the sensor 15 has been activated, the foreign body can be removed from inside the device 2, and the escalator then must be manually restarted; i.e. it will not restart automatically as it will when only the switch 31 has been activated.

It will be readily appreciated that the device of this invention provides a dual safety function in that objects impacting the reentry housing may cause the escalator to turn off, and objects which actually are pulled into the reentry housing by the handrail will also turn off the escalator. In the former instance, the escalator will automatically restart once the anomaly is removed, and in the latter instance, the escalator must be manually restarted. The components of the device are self adjustable and can conform to some degree of handrail wear and dirt buildup on the handrail without losing its ability to function as intended. The component parts of the device may all be molded from suitable plastics and thus can be accurately mass produced at low cost.

Since many changes and variations of the disclosed embodiment of the invention may be made without departing from the inventive concept, it is not intended to limit the invention otherwise than as required by the appended claims.

What is claimed is:

1. An escalator safety assembly for use at the reentry housing of a moving handrail on the escalator, said safety assembly comprising:

(a) a deformable resilient bumper member for mounting on the reentry housing, said bumper member being configured to surround the handrail and project from the reentry housing in a direction counter to the direction of movement of the handrail;

(b) an escalator control switch for mounting in the reentry housing, said switch being operable upon actuation to initiate a shut-off signal to stop the escalator and stop movement of the handrail; and (c) actuating means movably mounted between said bumper member and said switch, said actuating means being connected to said bumper member and normally held out of engagement with said switch by reason of the resiliency of said bumper member, and said actuating means being operable to contact and actuate said switch in response to sufficient deformation of said bumper member toward the reentry housing upon engagement between said bumper member and an object on the handrail.

2. The escalator safety assembly of claim 1 wherein said actuating means comprises a rigid housing member configured so as to surround the handrail, and including locking means for snap fitting onto said bumper member, said housing member including a plurality of elongated pin means extending therefrom toward said switch for selective actuating engagement with the latter.

3. The escalator safety assembly of claim 2 further comprising handrail guide means connected to said housing member for guiding movement of the handrail through said housing member, said guide means including rollers for contacting opposite sides of the handrail.

4. The escalator safety assembly of claim 2 further comprising radial pressure sensor means interposed between said bumper member and said housing member, said radial pressure sensor means being operable to detect the presence of foreign matter on the handrail between the bumper and the handrail, and operable to turn off power to the escalator when such foreign matter is detected.

* * * * *

UNITED STATES PATENT AND TRADEMARK OFFICE

CERTIFICATE OF CORRECTION

PATENT NO. : 4,976,345

DATED : December 11, 1990

INVENTOR(S) : Willy Adrian, et al.

It is certified that error appears in the above-identified patent and that said Letters Patent is hereby corrected as shown below: Title page;

Item (75):

Please add the following inventors:

Dietrich Herrmann

Detlev Abraham

Signed and Sealed this

Fourth Day of August, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 4,976,345

DATED : December 11, 1990

INVENTOR(S) : Willy Adrian, et al.

It is certified that error appears in the above-identified patent and that said Letters Patent is hereby corrected as shown below:

On title page item [75] correct the spelling of the inventor's name by deleting "Moldenhaur" and inserting --Moldenhauer-- in lieu thereof.

In the Abstract, line 6, please delete "if" and insert --If-- in lieu thereof.

In Column 2, line 42 after the word advances, please insert --.--.

Col. 2, line 49, delete the word "looking" and insert --locking-- in lieu thereof.

Signed and Sealed this

Twenty-second Day of December, 1992

*Attest:*

DOUGLAS B. COMER

*Attesting Officer*

*Acting Commissioner of Patents and Trademarks*